US011274499B2

(12) United States Patent
Hardin, Jr.

(10) Patent No.: US 11,274,499 B2
(45) Date of Patent: Mar. 15, 2022

(54) POINT-THE-BIT BOTTOM HOLE ASSEMBLY WITH REAMER

(71) Applicant: HALLIBURTON ENERGY SERVICES, INC., Houston, TX (US)

(72) Inventor: John Ransford Hardin, Jr., Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 112 days.

(21) Appl. No.: 16/616,598

(22) PCT Filed: Aug. 31, 2017

(86) PCT No.: PCT/US2017/049546
§ 371 (c)(1),
(2) Date: Nov. 25, 2019

(87) PCT Pub. No.: WO2019/045716
PCT Pub. Date: Mar. 7, 2019

(65) Prior Publication Data

US 2021/0207440 A1 Jul. 8, 2021

(51) Int. Cl.
*E21B 7/28* (2006.01)
*E21B 7/06* (2006.01)
(Continued)

(52) U.S. Cl.
CPC ..... *E21B 7/28* (2013.01); *E21B 7/068* (2013.01); *E21B 10/26* (2013.01); *E21B 10/32* (2013.01)

(58) Field of Classification Search
CPC . E21B 7/06; E21B 7/067; E21B 7/068; E21B 7/28; E21B 10/32
See application file for complete search history.

(56) References Cited

U.S. PATENT DOCUMENTS 4,653,598 A * 3/1987 Schuh ..... E21B 17/16 175/325.2
4,739,843 A 4/1988 Burton
(Continued)

FOREIGN PATENT DOCUMENTS

CA 2448134 C * 9/2009 ..... E21B 7/04
GB 2434388 A * 7/2007 ..... E21B 7/04
(Continued)

OTHER PUBLICATIONS

Extended European Search Report issued for European Application No. 17923632.8, dated Nov. 11, 2020 by the European Patent Office, 8 pages.
(Continued)

*Primary Examiner* — Jennifer H Gay
(74) *Attorney, Agent, or Firm* — Haynes and Boone, LLP

(57) ABSTRACT

A method includes extending a wellbore using a drill bit that forms a portion of a bottom hole assembly; enlarging a diameter of the wellbore using a reamer of the assembly; and laterally offsetting either a rotary steerable tool or a mud motor of the assembly in the enlarged diameter wellbore. A bend angle is defined between a central axis of either the rotary steerable tool or the mud motor creates and a central axis of the drill bit. Enlarging the diameter of the wellbore using the reamer while steering the assembly decreases the dogleg. Enlarging the diameter of the wellbore using the reamer while rotational drilling a straight section of the wellbore reduces stresses on the assembly and reduces wellbore tortuosity.

20 Claims, 6 Drawing Sheets

(51) Int. Cl.
*E21B 10/32* (2006.01)
*E21B 10/26* (2006.01)

(56) References Cited

U.S. PATENT DOCUMENTS 4,938,298 A * 7/1990 Rehm ..... E21B 7/04 175/61
5,060,736 A * 10/1991 Neff ..... E21B 7/068 175/74
5,090,496 A * 2/1992 Walker ..... E21B 7/068 175/61
5,113,953 A * 5/1992 Noble ..... E21B 7/068 175/61
5,458,208 A * 10/1995 Clarke ..... E21B 4/00 175/107
5,465,799 A * 11/1995 Ho ..... E21B 47/024 175/61
6,047,784 A * 4/2000 Dorel ..... E21B 7/068 175/61
6,092,610 A 7/2000 Kosmala et al.
6,269,892 B1 * 8/2001 Boulton ..... E21B 7/067 175/61
6,470,977 B1 * 10/2002 Chen ..... E21B 17/03 175/61
6,581,699 B1 * 6/2003 Chen ..... E21B 7/067 175/61
6,705,413 B1 3/2004 Tessari
7,147,066 B2 * 12/2006 Chen ..... E21B 7/067 175/61
7,513,318 B2 * 4/2009 Underwood ..... E21B 7/067 175/61
7,621,343 B2 * 11/2009 Chen ..... E21B 7/067 175/61
7,729,895 B2 * 6/2010 Chen ..... E21B 10/00 703/6
7,778,777 B2 * 8/2010 Chen ..... E21B 7/064 702/2
7,827,014 B2 * 11/2010 Chen ..... E21B 7/04 703/10
7,861,802 B2 * 1/2011 Underwood ..... E21B 7/04 175/76
8,141,657 B2 3/2012 Hutton
8,381,839 B2 * 2/2013 Rosenhauch ..... E21B 7/04 175/95
8,640,793 B2 * 2/2014 Wentworth ..... E21B 17/20 175/61
8,807,246 B2 8/2014 Lassoie et al.
9,500,034 B2 * 11/2016 Holtz ..... E21B 7/067
9,879,518 B2 * 1/2018 May ..... E21B 44/00
10,138,683 B2 * 11/2018 Strachan ..... E21B 7/062
10,221,627 B2 * 3/2019 Bayliss ..... E21B 7/06
2003/0024738 A1 * 2/2003 Schuh ..... E21B 7/04 175/45
2005/0269082 A1 * 12/2005 Baron ..... E21B 47/022 166/255.2
2006/0113113 A1 * 6/2006 Underwood ..... E21B 17/1014 175/61
2007/0029111 A1 * 2/2007 Chen ..... E21B 7/06 175/24
2007/0029113 A1 * 2/2007 Chen ..... E21B 41/00 175/45
2007/0032958 A1 * 2/2007 Chen ..... E21B 7/06 702/14
2007/0163810 A1 * 7/2007 Underwood ..... E21B 17/20 175/61
2007/0205022 A1 9/2007 Treviranus et al.
2007/0251726 A1 11/2007 Menger
2009/0056935 A1 * 3/2009 Prange ..... E21B 43/305 166/245
2010/0300758 A1 * 12/2010 Chen ..... E21B 41/00 175/61
2011/0077928 A1 * 3/2011 Chen ..... E21B 10/00 703/10
2012/0018218 A1 * 1/2012 Rosenhauch ..... E21B 7/04 175/24
2012/0285701 A1 * 11/2012 Cheng ..... E21B 43/30 166/369
2013/0043077 A1 * 2/2013 Chen ..... E21B 10/00 175/61
2013/0098686 A1 * 4/2013 Wentworth ..... E21B 7/062 175/45
2015/0101864 A1 * 4/2015 May ..... E21B 10/32 175/27
2015/0226009 A1 8/2015 Claudey
2015/0330150 A1 * 11/2015 Strachan ..... E21B 7/062 175/45
2016/0108679 A1 * 4/2016 Bayliss ..... E21B 7/068 175/45
2016/0230465 A1 * 8/2016 Holtz ..... E21B 49/00
2018/0187492 A1 * 7/2018 Amri ..... E21B 43/103
2019/0128069 A1 * 5/2019 Johnson ..... E21B 44/005
2020/0240212 A1 * 7/2020 von Gynz-Rekowski ..... E21B 4/003
2021/0207440 A1 * 7/2021 Hardin, Jr. ..... E21B 10/26

FOREIGN PATENT DOCUMENTS

WO WO-9529319 A1 * 11/1995 ..... E21B 47/007
WO WO-0037764 A2 * 6/2000 ..... E21B 7/068
WO WO-2010039317 A1 * 4/2010 ..... E21B 47/022
WO WO-2011096964 A1 * 8/2011 ..... E21B 43/30
WO WO2016/060976 A1 4/2016
WO WO-2018118020 A1 * 6/2018 ..... G06F 19/00
WO WO-2019051435 A1 * 3/2019 ..... G06Q 10/063

OTHER PUBLICATIONS

International Search Report and Written Opinion issued for International Application No. PCT/US2017/049546, ISA/KR, dated May 30, 2018, 15 pages.

* cited by examiner

POINT-THE-BIT BOTTOM HOLE ASSEMBLY WITH REAMER

CROSS-REFERENCE TO RELATED APPLICATION

The present application is a U.S. National Stage patent application of International Patent Application No. PCT/US2017/049546, filed on Aug. 31, 2017, the benefit of which is claimed and the disclosure of which is incorporated herein by reference in its entirety.

TECHNICAL FIELD

The present disclosure relates generally to a method of drilling a wellbore, and specifically, to a method of enlarging the diameter of the wellbore using a point-the-bit bottom hole assembly having a reamer to reduce dogleg capability associated with the bottom hole assembly and/or reduce wellbore tortuosity.

BACKGROUND

Directional drilling operations involve controlling the direction of a wellbore as it is being drilled. Generally, the goal of directional drilling is to reach a target subterranean destination with a drill string, and often the drill string will need to be turned through a tight radius to reach the target destination. Generally, a rotary steerable tool or a mud motor that forms a portion of the bottom hole assembly ("BHA") is used to steer the BHA to create a curved section of the wellbore. Often, the rotary steerable tool and mud motor are fixed, when run downhole, at a given bend angle or displacement that embodies the maximum dogleg capability of the bottom hole assembly. There are instances when the maximum dogleg capability is not needed, such as when the drill string is creating a generally straight section of the wellbore and/or when the radius of a required turn is not as tight as the radius associated with the maximum dogleg capability. In these instances and when a point-the-bit bottom hole assembly with a fixed maximum dogleg capability is used, large lateral forces are exerted on the drill bit, bearings, stabilizers, pads, etc., resulting in very high stresses on housings, shafts, mandrels, internal connections, external connections, etc. of the rotary steerable tool or mud motor. These high forces and stresses can lead to equipment failures, non-productive time, and potentially the loss of a well. In addition, transitions from steering to straight drilling and vice-versa impart significant tortuosity to the wellbore.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Illustrative embodiments and related methods of the present disclosure are described below as they might be employed using a point-the-bit bottom hole assembly with reamer. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

Figure 1A:
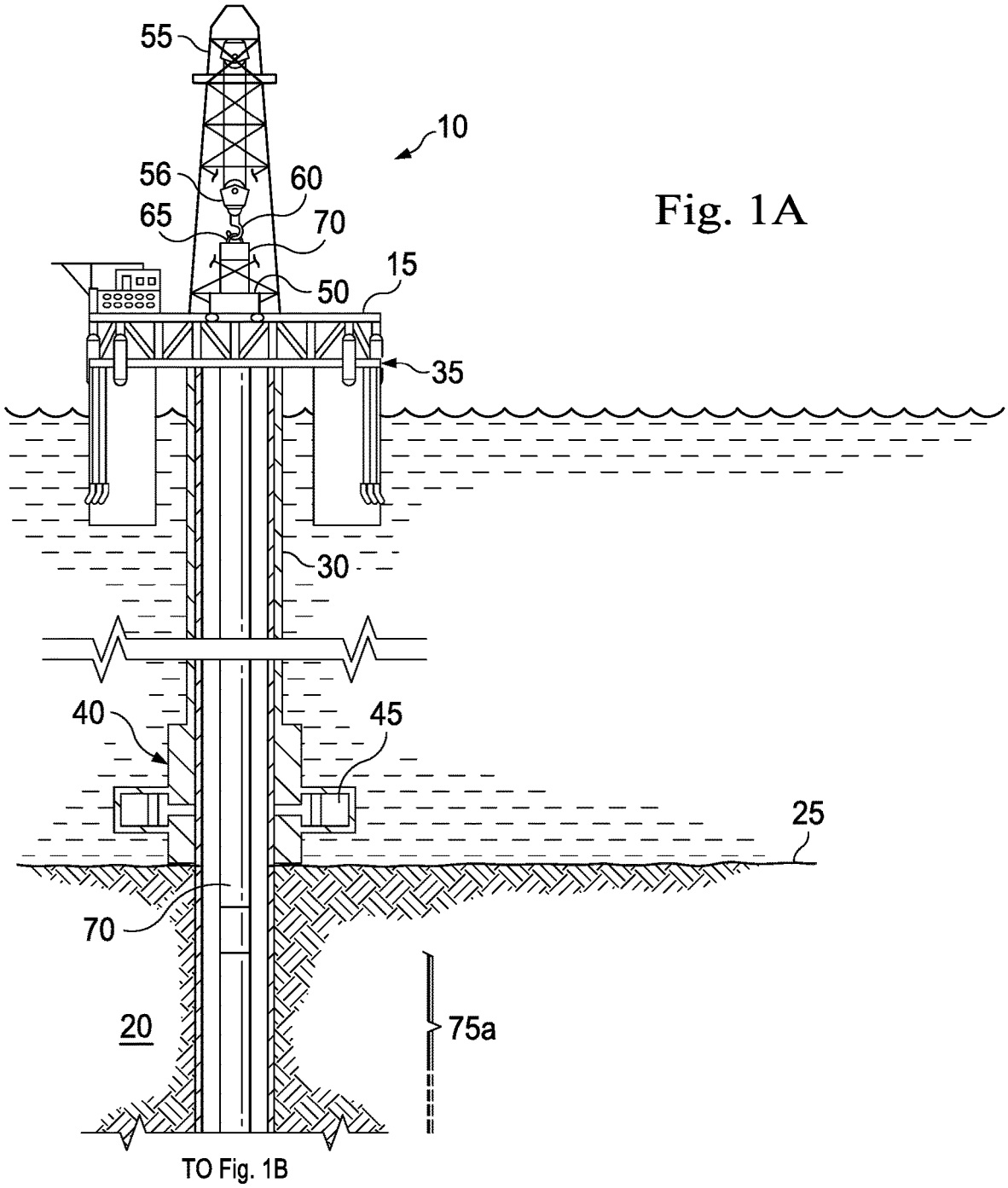
FIGS. 1A and 1B together form a schematic illustration of an offshore oil and gas platform operably coupled to a point-the-bit bottom hole assembly with reamer, according to an exemplary embodiment of the present disclosure.
Figure 1B:
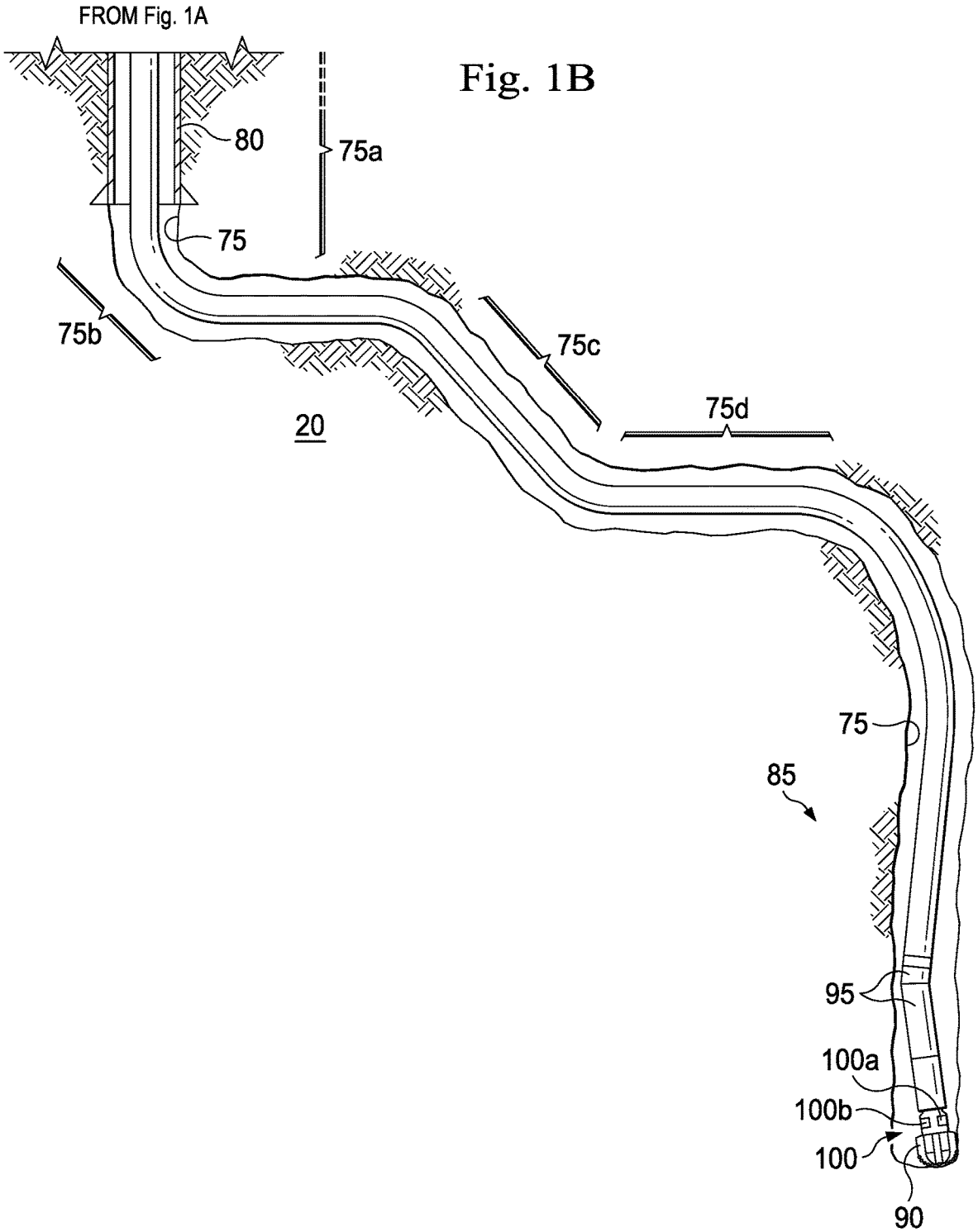

Referring to FIGS. 1A and 1B, a point-the-bit bottom hole assembly having a reamer that is extending, or forming, a wellbore from an offshore oil or gas platform, is schematically illustrated and generally designated 10. A semi-submersible platform 15 is positioned over a submerged oil and gas formation 20 located below a sea floor 25. A subsea conduit 30 extends from a deck 35 of the platform 15 to a subsea wellhead installation 40, including blowout preventers 45. The platform 15 has a hoisting apparatus 50, a derrick 55, a travel block 56, a hook 60, and a swivel 65 for raising and lowering pipe strings, such as a substantially tubular, axially extending drill string 70. A wellbore 75 extends through the various earth strata including the formation 20, with some portions of the 75 having a casing string 80 cemented therein. However, in some embodiments the entirety of the wellbore 75 may be an open hole wellbore.

The wellbore 75 includes any one or more of a vertical section 75*a*, a curved section 75*b*, a tangent section 75*c*, and a horizontal section 75*d*. The wellbore 75 may be an uphill wellbore and/or include multilateral wellbores. Accordingly, it should be understood by those skilled in the art that the use of directional terms such as "above," "below," "upper," "lower," "upward," "downward," "uphole," "downhole" and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIGS. 1A and 1B depicts an offshore operation, it should be understood by those skilled in the art that the apparatus according to the present disclosure is equally well suited for use in onshore operations.

A point-the-bit bottom hole assembly 85, or the BHA 85, is coupled to the lower or distal end of the drill string 70 and includes a drill bit 90 that is operably coupled to a steering tool 95, such as a mud motor or a rotary steerable system, suitable for selectively changing a direction of drilling by the BHA 85. A reamer 100 also forms a portion of the BHA 85 and is coupled to, and positioned between, the drill bit 90 and the steering tool 95. This positioning between includes the reamer 100 being built into or forming a portion of the drill bit 90, and thus positioned below the steering tool 95; the reamer 100 being built into or forming another tool that is positioned between the drill bit 90 and the steering tool 95; and the reamer 100 being built into a lower end of the steering tool 95. Generally, the reamer 100 is positioned downhole from the "bend" in the steering tool 95. The reamer 100 may be any wellbore diameter enlargement device and may be a single actuation reamer or a multi-actuation reamer such that the reamer 100 can be activated and deactivated multiple times. Generally, the reamer 100 includes reamer cutting structures 100*a* and 100*b* that, when activated, extend radially in a direction perpendicular to a longitudinal axis of the reamer 100 to contact a wall of the wellbore 75 and enlarge the diameter of the wellbore 75. While only two reamer cutting structures are shown in FIGS. 1 and 3-5, the reamer 100 may include any number of reamer cutting structures spaced circumferentially and/or longitudinally along the reamer 100. The BHA 85 is a point-the-bit system in that a central axis 95*a* of the steering tool 95 (shown in FIG. 3) creates a bend angle 102 relative to a central axis 90*a* of the drill bit 90. That is, the bend angle 102 is defined between the central axis 90*a* and the central axis 95*a*. In some instances, the bend angle 102, among other factors such as a bit-to-bend distance, placement of the steering tool 95 relative to other tools that form the BHA 85 etc., defines a dogleg capability of the BHA 85. The dogleg achieved by a particular steering tool 95 will depend at least in part on the bend angle 102, and may also depend on a bit-to-bend distance, placement of the steering tool 95 relative to other tools that form the BHA 85 etc. The dogleg capability associated with the BHA 85 is the measure of the amount of change in the inclination, and/or azimuth of a wellbore, usually expressed in degrees per 100 feet of course length that the BHA 85 is capable of creating during steering of the BHA 85. Hence, the dogleg capability of a particular steering tool 95 depends at least in part on a maximum bend angle, and may further depend on the bit-to-bend distance, placement of the steering tool 95 relative to other tools that form the BHA 85 etc.

Often, the wellbore 75 will have a planned trajectory such that the curved section 75*b* is associated with a dogleg, such as for example 10 degrees per 100 ft. In these instances, and when the bend angle 102 of the steering tool 95 is fixed prior to being run downhole, the bend angle 102 (along with the other factors that determine dogleg capability) is often set to be in excess of what is needed to accomplish the 10 degrees per 100 ft. Thus, the bend angle 102 is often capable of producing a dogleg capability of, for example, 12 or 13 degrees per 100 ft. Having excess dogleg capability provides the capacity to catch up to the planned wellbore path or trajectory if the drilled wellbore gets behind the plan for any reason, but also can result in the multiple transitions from steering to drilling straight sections in order to create a curved section that has a dogleg that is less than the fixed dogleg capability that is associated with the BHA 85. Activating the reamer 100 to enlarge a diameter of the wellbore decreases the fixed dogleg capability associated with the BHA 85 to reduce the number of transitions from steering to drilling straight when creating a curved section and to reduce the stresses exerted on the BHA 85 during such transitions and when drilling straight sections.

In some embodiments and generally when the steering tool 95 is a mud motor, the drilling string 70 is not rotated during steering of the BHA 85 such that the orientation of the steering tool 95 in the wellbore 75 is stationary. However, in other embodiments and generally when the steering tool 95 is a rotary steerable system, the drilling string 70 is rotated while steering of the BHA 85, but the orientation of the steering tool 95 in the wellbore 75 is stationary. Generally, when drilling a straight section of the wellbore 75, the drilling string 70 and the BHA 85 rotate together or at least the orientation of the BHA 85 in the wellbore 75 is not stationary.

Figure 2:
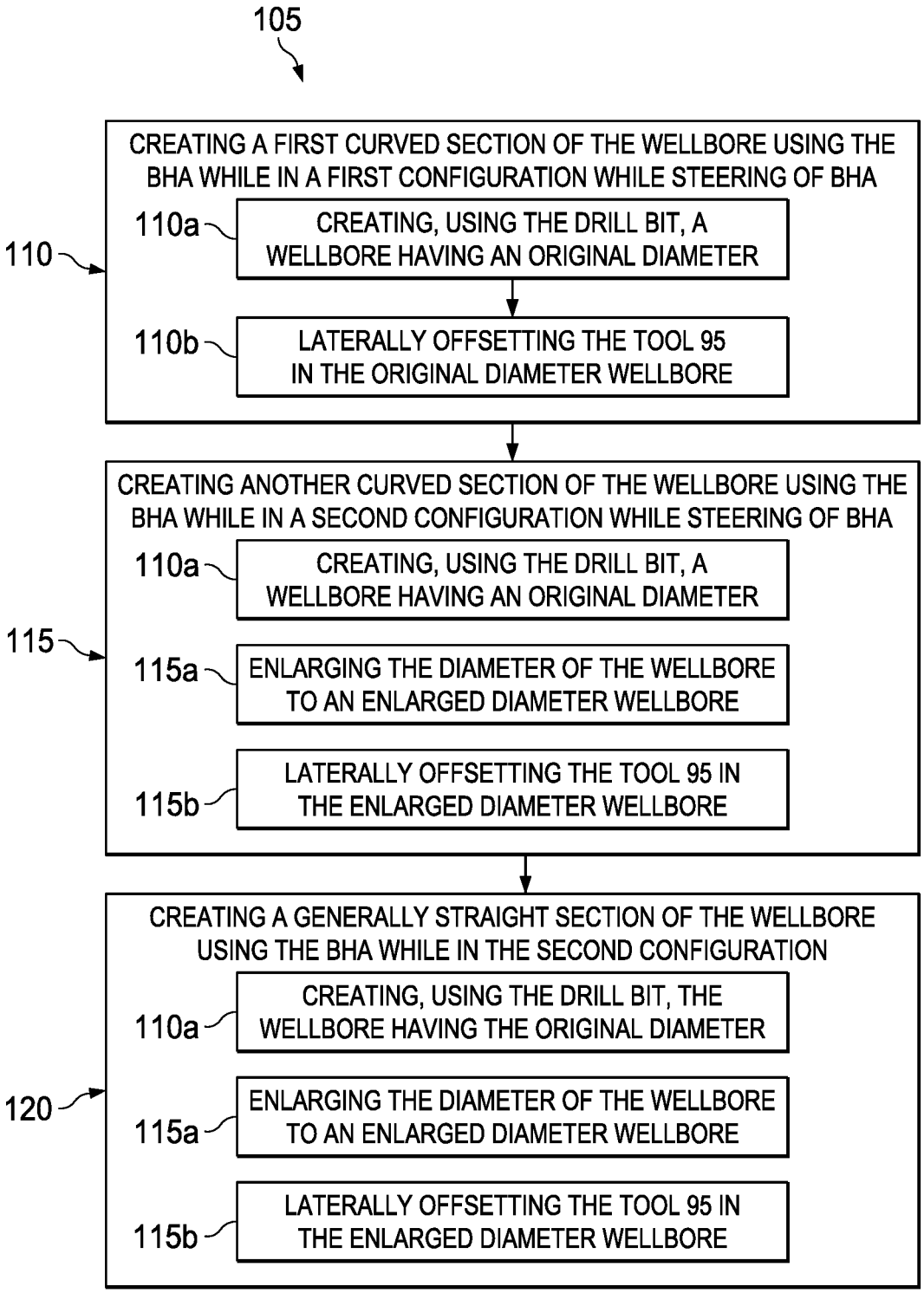
FIG. 2 is a flow chart illustration of a method of operating the point-the-bit bottom hole assembly with reamer of FIG. 1, according to an exemplary embodiment of the present disclosure.

In an exemplary embodiment, as illustrated in FIG. 2 with continuing reference to FIG. 1, a method 105 of extending the wellbore 75 includes creating a first curved section of the wellbore 75 using the BHA 85 while the BHA 85 is in a first configuration while steering the BHA 85 at step 110; creating a second curved section of the wellbore 75 using the BHA 85 while the BHA 85 is in a second configuration while steering the BHA 85 at step 115; and creating a straight or a generally straight section (e.g., vertical, tangent, horizontal, lateral) of the wellbore 75 using the BHA 85 while the BHA 85 is in the second configuration at step 120.

Figure 3:
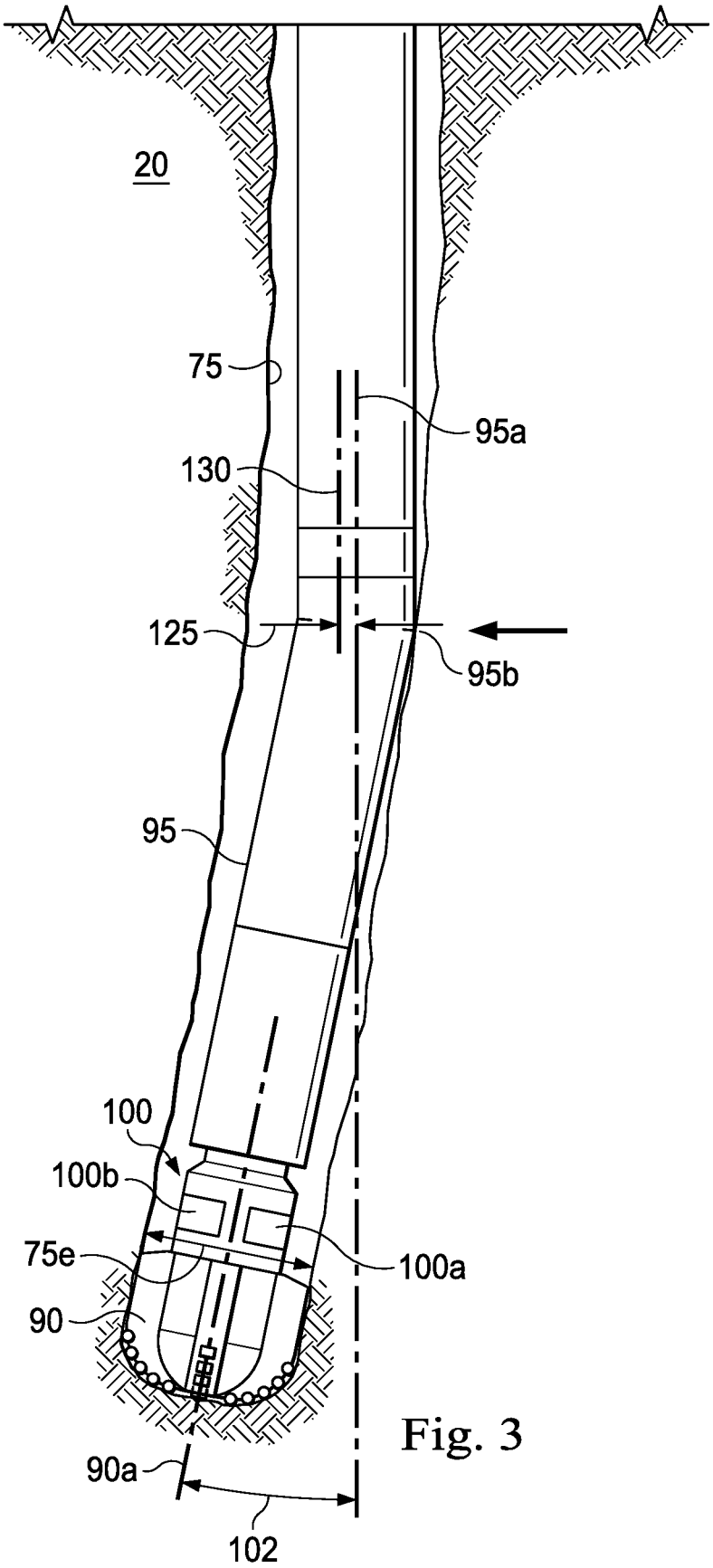
FIG. 3 is a schematic illustration of the bottom hole assembly of FIG. 1 during one step of the method of FIG. 2, according to an exemplary embodiment of the present disclosure.
Figure 4:
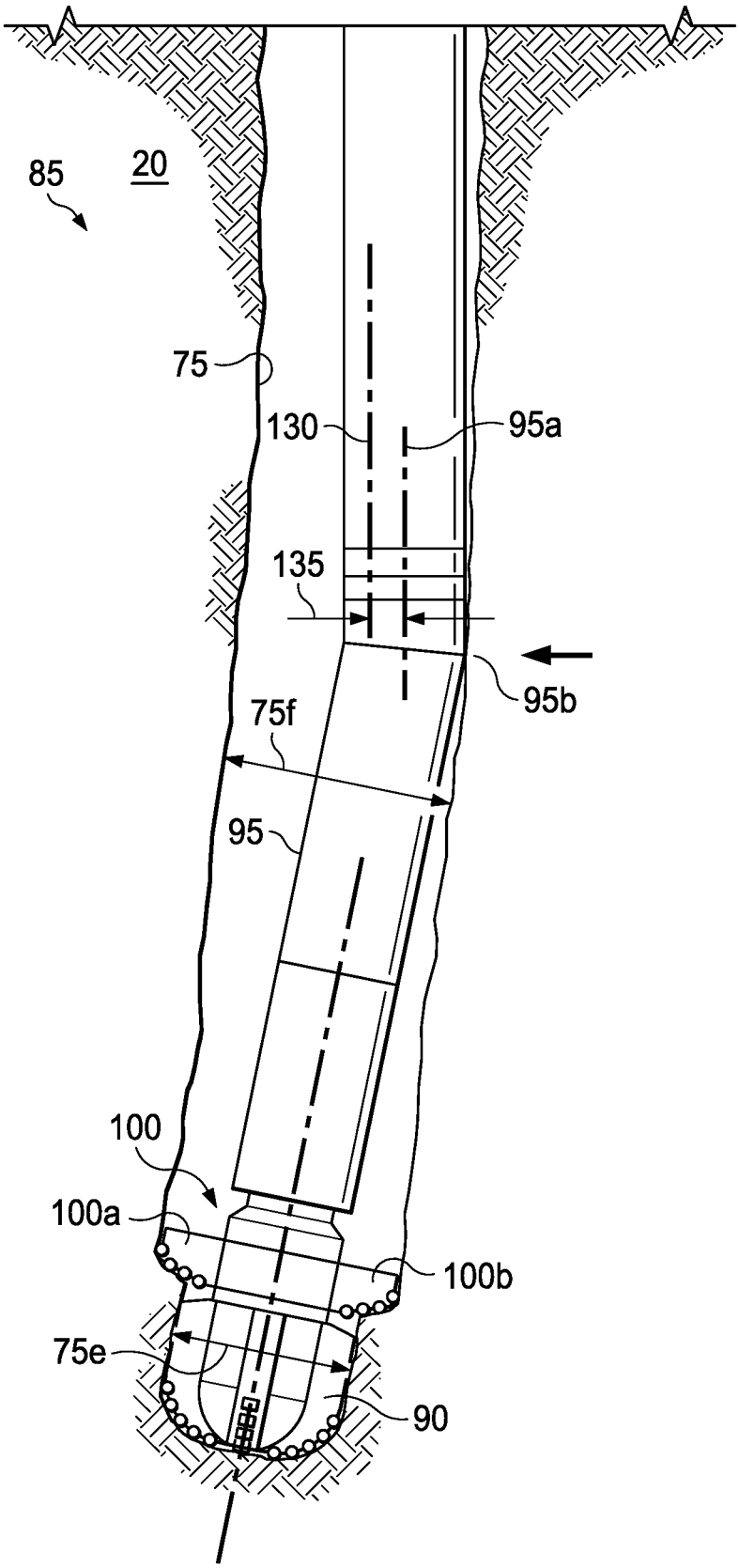
FIG. 4 is schematic illustration of the bottom hole assembly of FIG. 1 during another step of the method of FIG. 2, according to an exemplary embodiment of the present disclosure.
Figure 5:
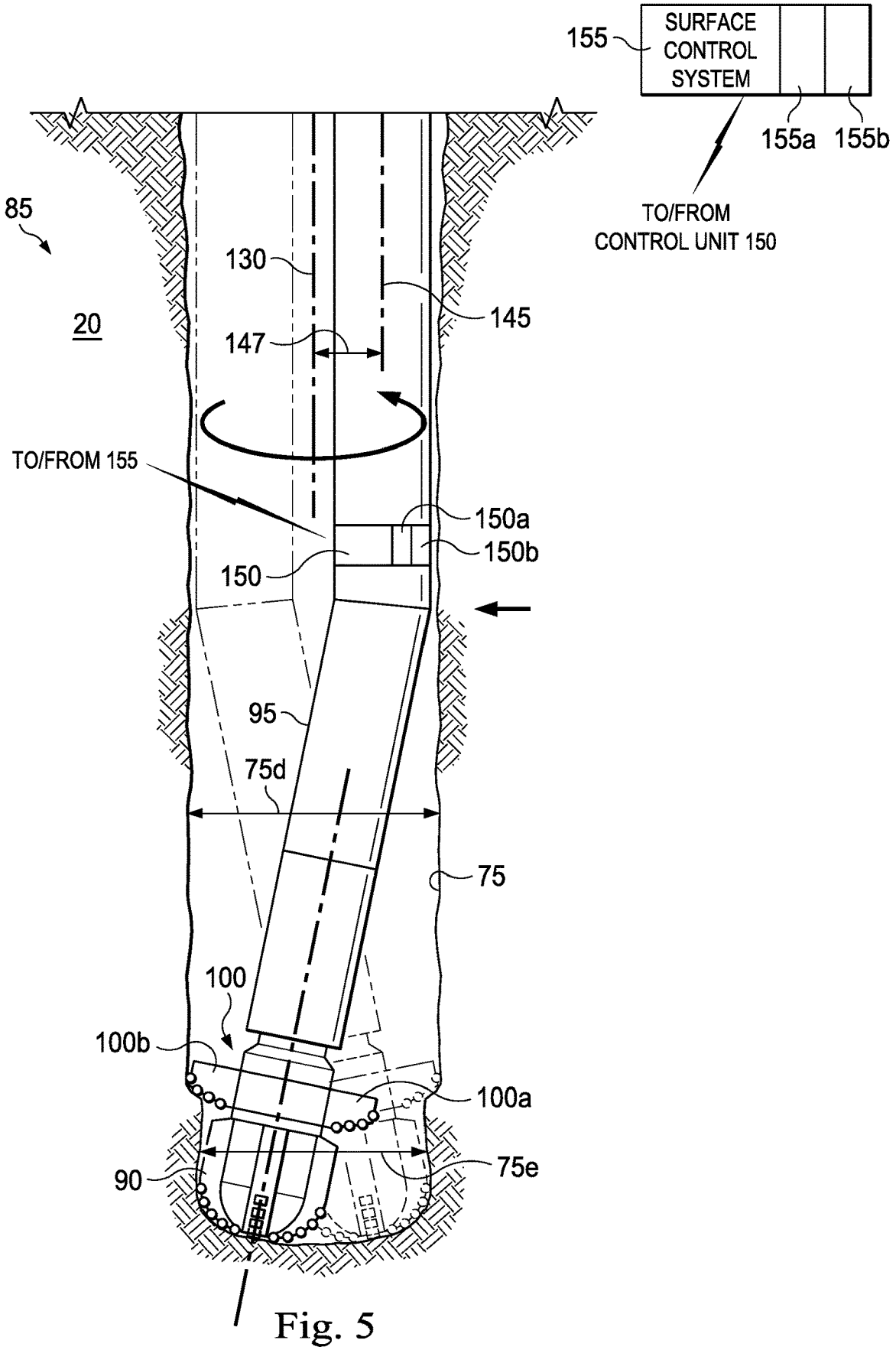
FIG. 5 is a schematic illustration of the bottom hole assembly of FIG. 1 during yet another step of the method of FIG. 2, according to an exemplary embodiment of the present disclosure.

The step 110 includes the sub steps of creating, using the drill bit 90, the wellbore 75 having an original diameter illustrated by the dimension having the reference numeral 75*e* in FIGS. 3-5 at step 110*a* and laterally offsetting the steering tool 95 in the original diameter 75*e* wellbore at step 110*b*. FIG. 3 illustrates the BHA 85 in the first configuration while drilling a curved section of the wellbore 75. When in the first configuration, the reamer cutting structures 100*a* and 100*b* are in a retracted position such that the reamer cutting structures 100*a* and 100*b* do not enlarge the diameter of the wellbore 75. To create a curved section of the wellbore 75 the drill bit 90 creates a portion of the wellbore 75 having the original diameter 75*e* that corresponds to a diameter of the drill bit 90. In some embodiments, the original diameter 75*e* is not equal to the diameter of the drill bit 90, but at least a function of the diameter of the drill bit 90. As the reamer 100 of the BHA 85 is placed or remains in the first configuration, the reamer cutting structures 100*a* and 100*b* do not enlarge the original diameter 75*e* of the wellbore 75. Placing, or allowing, the reamer 100 to stay in the first configuration restores, or otherwise results in the BHA 85 creating a first dogleg or portion of the wellbore that has a first radius of curvature. This first radius of curvature often corresponds to the fixed dogleg capability of the BHA 85, which can include the excess dogleg capability. The central axis 95*a* of the steering tool 95 is laterally offset from a center of the wellbore 75 by a distance 125, with the center of the wellbore 75 illustrated as the line having a reference numeral 130 in FIGS. 3-5 ("center 130"). Thus, a contact point 95*b* of the steering tool 95 is also offset from the center 130 and results in a side-cutting force or leverage applied to the drill bit 90 to enable laterally drilling while also drilling axially. Generally, the steps of 110*a* and 110*b* occur simultaneously.

When it is desired to create a portion of the wellbore that has a radius of curvature that is greater than the first radius of curvature, the reamer cutting structures 100*a* and 100*b* are deployed or activated such that the reamer 100 is in the second configuration to enlarge the original wellbore 75*e* to an enlarged diameter illustrated by the dimension having numeral 75*f* in FIGS. 4-5. The enlarged diameter 75*f* is greater than the original diameter 75*e*. Generally, the reduction of dogleg, or the increase in the radius of curvature is a function of the amount of wellbore "overage", or difference between the enlarged diameter 75*f* and the original diameter 75*e*. Thus, an outermost diameter of the reamer 100 when the reamer 100 is in the second configuration is sized to create the desired reduction of dogleg, or increase in the radius of curvature. In some embodiments, the reamer cutting structures 100*a* and 100*b* are capable of extending to one of a plurality of radial distances from the reamer 100 such that the reamer 100 is capable of enlarging the diameter of the wellbore to different diameters.

The step 115 includes the sub steps of the step 110*a*, enlarging the diameter of the wellbore 75 to the enlarged diameter 75*f* at step 115*a*, and laterally offsetting the steering tool 95 in the enlarged diameter 75*f* of the wellbore 75 at step 115*b*. FIG. 4 illustrates the BHA 85 in the second configuration and drilling a curved section of the wellbore 75. To create the second curved section of the wellbore 75 that has a radius of curvature that is greater than the first radius of curvature, the drill bit 90 creates a portion of the wellbore 75 having the original diameter 75*e* that corresponds to a diameter of the drill bit 90 at the step 110*a*. During the step 115, the reamer 100 is placed in or is maintained in the second configuration. Thus, at step 115*b*, the reamer cutting structures 100*a* and 100*b* enlarges the diameter of the wellbore 75 from the original diameter 75*e* to the enlarged diameter 75*f*. At the step 115*c*, the steering tool 95 is laterally offset from the center 130 of the enlarged diameter 75*f* wellbore by a distance 135 from the center 130. That is, the contact point 95*b* of the steering tool 95 is offset from the center 130 by the distance 135, which is greater than the distance 125. This generally results in a reduction of the side-cutting force or leverage applied to the drill bit 90 when laterally and axially drilling. Reducing the side-cutting force or leverage applied to the drill bit 90 increases the radius of curvature of the curved section being drilled and, effectively, reduces the dogleg capability of the BHA 85. Generally, the steps of 110*a*, 115*a*, and 115*b* occur simultaneously.

The step 120 includes the sub steps of the steps 110*a*, 115*a*, and 115*b*, and is similar to the step 115 except that the step 115 occurs during steering of the BHA 85 and the step 120 occurs when the BHA 85 rotates to drill a straight section. Thus, the step 120 results in a generally straight section of the wellbore 75. FIG. 5 illustrates the BHA 85 while in the second configuration and drilling a generally straight section of the wellbore 75 during rotational drilling, or when the BHA 85 is rotating. As previously noted, the drill bit 90 creates a portion of the wellbore 75 having the original diameter 75*e* that corresponds to a diameter of the drill bit 90 at the step 110*a*. During drilling of a straight section, the original diameter 75*e* of the wellbore 75 not only corresponds to the diameter of the drill bit 90, but on other factors such as the bend angle 102, distance between the drill bit 90 and the steering tool 95, etc. The reamer 100 is placed in or is maintained in the second configuration during the step 120, thus the reamer cutting structures 100*a* and 100*b* are extended. At step 115*a*, the reamer cutting structures 100*a* and 100*b* enlarge the diameter of the wellbore 75 from the original diameter 75*e* to the enlarged diameter 75*f*. At the step 115*b*, one central axis 145 of the BHA 85 has a maximum lateral offset from the center 130 of the enlarged diameter 75*f* wellbore 75 by a distance 147. The distance 147 is greater when the BHA 85 is offset in the enlarged diameter 75*f* than the distance 147 when the BHA 85 is offset in the original diameter 75*e*. This enlargement of the wellbore diameter reduces the forces exerted on, and the stresses imposed on, the BHA 85 due to the bend angle 102 of the steering tool 95. Generally, the steps of 110*a*, 115*a*, and 115*b* occur simultaneously during drilling of a tangent, vertical, or lateral section of the wellbore 75.

Any variety of wellbore diameter enlarging tools can be used in place of the reamer 100. In some cases, a single actuation of the reamer 100 may be acceptable. For example, once the curved section 75*b* is drilled using the first dogleg capability (i.e., the reamer 100 in the first configuration), the reamer 100 may be irreversibly activated such that the reamer cutting structures 100*a* and 100*b* are moved outward to enlarge the wellbore for the remainder of the bitrun in order to drill with a dogleg capability that is less than the first dogleg capability associated with the BHA 85 while in the first configuration. Examples of single, irreversible activation of the reamer 100 include the use of shear pins based on high differential pressure and ball drops.

In some embodiments, a control unit 150 as illustrated in FIG. 5 is provided to control the BHA 85, under conditions to be described below. In one exemplary embodiment, the control unit 150 is connected to, and/or disposed within, the steering tool 95, although it may be located anywhere along the BHA 85. In one exemplary embodiment, the control unit 150 includes one or more measurement-while-drilling ("MWD") systems, one or more logging-while-drilling ("LWD") systems, and/or any combination thereof. In one exemplary embodiment, the control unit 150 includes one or more processors 150*a*, a memory or computer readable medium 150*b* operably coupled to the one or more processors 150*a*, and a plurality of instructions stored in the computer readable medium 150*b* and executable by the one or more processors 150*a*. A surface control unit or system 155 is in two-way communication with the control unit 150. In one exemplary embodiment, the surface control system 155 includes one or more processors 155*a*, a memory or computer readable medium 155*b* operably coupled to the one or more processors 155*a*, and a plurality of instructions stored in the computer readable medium 155*b* and executable by the one or more processors 155*a*. During operation, the control unit 150 positioned in the wellbore 75 communicates with the surface control system 155, sending directional survey information to the surface control system 155 using a telemetry system. The telemetry system may utilize mud-pulse telemetry or the like. In any event, the control unit 150 may transmit to the surface control system 155 information about the direction, inclination and orientation of the BHA 85. In one exemplary embodiment, the surface control system 155 controls the BHA 85 via the control unit 150. During operation and when the reamer 100 is operably coupled to the control unit 150 such that the control unit 150 controls the actuation of the reamer cutting structure 100*a*, the control unit 150 actuates the reamer cutting structure 100*a* to place the reamer 100 in the first configuration, the second configuration, third configuration that is different from both the first and second configuration and that also enlarges the diameter of the wellbore, back to the first configuration, and back to the second configuration, or any combination thereof. That is, the reamer 100 may have a variety of configurations that correspond with a variety of wellbore diameters. In one exemplary embodiment, one or both of the control unit 150 and the surface control system 155 are part of a downlink system that allows for automatic steering along a fixed or preprogrammed trajectory towards the desired target location in the formation 20. In one exemplary embodiment, to control the BHA 85 using the surface control system 155 and/or the control unit 150, the one or more processors 150*a* and/or the one or more processors 155*a* execute the plurality of instructions stored in the computer readable medium 150*b* and/or the plurality of instructions stored in the computer readable medium 155*b*.

While the bend angle 102 of the steering tool 95 described by way of example as being fixed when downhole, a tool may alternately include an adjustable bend angle, in which case, one or more embodiments of the steering tool 95 may have at least a straight mode with zero or near zero bend angle or displacement that can alternate between deflected and straight modes downhole. Optionally, the bend angle may be selectively adjustable to any of a range of values. Use of the steering tool 95, when the steering tool 95 has the ability to alternate between deflected and straight modes downhole, in the method 105 results in the creation of intermediate dogleg capabilities when the diameter of the wellbore 75 is enlarged.

Moreover, another embodiment of the steering tool 95 has self-adjusting dogleg capabilities. Use of the steering tool 95, when the steering tool 95 has self-adjusting dogleg capabilities, in the method 105 results in the reduction of the dogleg capability when the diameter of the wellbore 75 is enlarged.

In an exemplary embodiment, creating a generally straight section of the wellbore includes creating a section of the wellbore that is intended to be generally straight but includes some deviations.

In several exemplary embodiments, the method 105 may be implemented in whole or in part by a computer. The plurality of instructions stored on the computer readable medium 150*b*, the plurality of instructions stored on the computer readable medium 155*b*, a plurality of instructions stored on another computer readable medium, and/or any combination thereof, may be executed by a processor to cause the processor to carry out or implement in whole or in part the method 105, and/or to carry out in whole or in part the above-described operation of the BHA 85. In several exemplary embodiments, such a processor may include the one or more processors 150*a*, the one or more processors 155*a*, one or more additional processors, and/or any combination thereof.

As noted above, having excess dogleg capability provides the capacity to catch up to the planned wellbore path or trajectory if the drilled wellbore gets behind the plan for any reason. Use of the BHA 85 and/or the method 105 allows for the use of the excess bend angle when necessary, but otherwise reduces the effects of the excess bend angle when the excess bend angle is not required. Thus, when creating the curved section 75*b*, the BHA 85 creates a curved section having a radius of curvature that is greater than the radius of curvature associated the excess bend angle. This reduces the need for approximating the desired curve by creating alternate segments of the wellbore 75 when steering to create a curvature is too tight and drilling straighter segments. Thus, the BHA 85 and/or the method 105 reduces the number of transitions from steering drilling to straight drilling. Transitions from steering to straight drilling involves "back-bending", or forcing the bend angle 102 against the curvature created during steering as the bend angle 102 is rotated. Large lateral forces on the drill bit 90, bearings, stabilizers, etc. are exerted during "back-bending" and result in very high stresses on housings, shafts mandrels, internal connections, external connections, etc. of the steering tool 95 (e.g., rotary steerable tool or mud motor). These high forces and stresses can lead to equipment failures, non-productive time, and potentially the loss of a well. In addition, transitions from steering to straight drilling and vice-versa can impart significant tortuosity to the wellbore 75. Wellbore tortuosity creates higher contact forces with the BHA 85 and/or the drill string 70, increasing frictional drag which inhibits weight transfer to the drill bit 90, which impedes drilling ahead, drilling long tangent or horizontal/lateral sections beyond the curve, and running casing and completions equipment. Thus, as the BHA 85 and/or the method 105 reduces the number of transitions from steering to straight drilling, the BHA 85 and/or the method 105 reduces lateral forces on the BHA 85, such as on the drill bit 90, bearings, stabilizers, etc. and reduces the associated stresses on the BHA 85, such as on housings, shafts, mandrels, internal connections, external connections, etc. Moreover, use of the BHA 85 and/or the method 105 reduces wellbore tortuosity. Moreover, when the drill string 70 extends within or through the enlarged diameter wellbore 75*f*, friction forces acting on the drill string 70 due to the contact with a wall of the wellbore 75 are generally less than friction forces acting on the drill string 70 when the drill string 70 extends through the original diameter wellbore 75*e*.

The BHA 85 and/or the method 105 results in the ability to have a high dogleg capability for the curved section 75*b* of the wellbore 75 and a reduced dogleg capability for making corrections in other portions of the wellbore 75 thereby creating a multi-dogleg-capability BHA 85. The multi-dogleg-capability 85 reduces equipment failures, non-productive time, and potentially the loss of a well. The multi-dogleg-capability BHA 85 reduces frictional drag, which improves weight transfer to the drill bit 90 which supports drilling ahead, drilling long tangent or horizontal/lateral sections beyond the curve, and running casing and completions equipment.

In some embodiments and if the diameter of the wellbore 75 is enlarged sufficiently, the effect of the bend angle 102 on dogleg capability can be completely overcome. Enlarging the diameter of the wellbore 75 provides room for the contact points, such as 95*b* of the steering tool 95 or other contact points of the BHA 85, to shift laterally, which reduces the effect of the bend angle 102 on the side-cutting force or leverage applied to the drill bit 90 and thereby results in a lower dogleg capability.

In some embodiments, the BHA 85 and/or the method 105 reduces the number of bitruns for each well as the BHA 85 is capable of creating a variety of segments of the well (e.g., the vertical section 75*a*, the curved section 75*b*, the tangent section 75*c*, the horizontal section 75*d*) while reducing stresses on the BHA 85 and reducing wellbore tortuosity.

Thus a method has been described. Embodiments of the method may generally include extending a wellbore using a drill bit; enlarging a diameter of the wellbore using a first tool; and laterally offsetting a second tool in the enlarged diameter wellbore; wherein the first tool, the second tool, and the drill bit are coupled together such that the first tool is positioned between the drill bit and the second tool; and wherein a bend angle is defined between a central axis of the second tool and a central axis of the drill bit. Any of the foregoing embodiments may include any one of the following elements, alone or in combination with each other:

Extending the wellbore using the drill bit, enlarging the diameter of the wellbore, and laterally offsetting the second tool in the enlarged diameter wellbore occur simultaneously to drill a first curved section that has a first dogleg severity.

Creating a second curved section of the wellbore having a second dogleg severity that is greater than the first dogleg severity, comprising extending the wellbore using the drill bit such that the wellbore has an original diameter while simultaneously laterally offsetting the second tool in the original diameter wellbore.

Laterally offsetting the second tool in the enlarged diameter occurs while the second tool and the drill bit are rotated to drill a straight section of the wellbore.

Laterally offsetting the second tool in the enlarged diameter wellbore reduces stresses exerted on the drill bit, the first tool, and the second tool when the second tool and the drill bit are rotated to drill the straight section of the wellbore.

Extending the wellbore using the drill bit such that the wellbore has an original diameter while simultaneously laterally offsetting the second tool in the original diameter wellbore to drill a first curved section having a first radius of curvature; extending the wellbore using the drill bit, enlarging the diameter of the wellbore, and laterally offsetting the second tool in the enlarged diameter wellbore occur simultaneously to drill a second curved section having a second radius of curvature; and the second radius of curvature is greater than the first radius of curvature.

Extending the wellbore using the drill bit such that the wellbore has an original diameter while simultaneously laterally offsetting the second tool in the original diameter wellbore such that the second tool is laterally offset from a center of the wellbore by a first distance; and, when the second tool is laterally offset in the enlarged diameter wellbore the second tool is laterally offset from the center of the wellbore by a second distance that is greater than the first distance to reduce a lateral force exerted on the drill bit.

The first tool is a reamer and enlarging the diameter of the wellbore includes activating the reamer.

Deactivating the reamer.

The second tool includes a mud motor or a rotary steerable system.

Thus a method has been described. Embodiments of the method may generally include extending a wellbore, using a drill bit and a mud motor having a bend angle, while simultaneously enlarging a diameter of the wellbore using a reamer positioned between at least a portion of the drill bit and at least a portion of the mud motor. Any of the foregoing embodiments may include any one of the following elements, alone or in combination with each other:

Laterally offsetting the mud motor in the enlarged diameter wellbore.

Extending the wellbore, using the drill bit and the mud motor, such that the wellbore has an original diameter while simultaneously laterally offsetting the mud motor in the original diameter wellbore.

Extending the wellbore using the drill bit and the mud motor, enlarging the diameter of the wellbore, and laterally offsetting the mud motor in the enlarged diameter wellbore, occur simultaneously during rotational drilling of a straight section of the wellbore.

Extending the wellbore, using the drill bit and the mud motor, such that the wellbore has the original diameter while simultaneously laterally offsetting the mud motor in the original diameter wellbore occurs during steering of the drill bit.

Laterally offsetting the mud motor in the enlarged diameter wellbore reduces stresses exerted on a bottom hole assembly that comprises the drill bit and the mud motor during rotation of the bottom hole assembly when drilling of a straight section of the wellbore.

Extending the wellbore using the drill bit and the mud motor, enlarging the diameter of the wellbore, and laterally offsetting the mud motor in the enlarged diameter wellbore creates a portion of the wellbore having a first radius of curvature.

Laterally offsetting the mud motor in the enlarged diameter wellbore reduces stresses exerted on the bottom hole assembly during rotational drilling.

Extending the wellbore using the drill bit and mud motor, enlarging the diameter of the wellbore, and laterally offsetting the mud motor in the enlarged diameter wellbore creates another portion of the wellbore having a second radius of curvature that is greater than the first radius of curvature.

Thus, a point-the-bit BHA has been described. Embodiments of the BHA may generally include a drill bit; a mud motor operably coupled to the drill bit; and a reamer positioned between one end of the mud motor and the drill bit. Any of the foregoing embodiments may include any one of the following elements, alone or in combination with each other:

The mud motor defines a bend angle.

The reamer is a multi-actuation reamer.

The reamer is movable between a first configuration and a second configuration; wherein, when in the first configuration, a cutting structure that is capable of extending radially in a direction perpendicular to a longitudinal axis of the reamer is retracted; wherein, when in the second configuration, the cutting structure is radially extended to form an outermost diameter of the reamer; and wherein, when in the second configuration, the outermost diameter of the reamer is greater than an outer diameter of the drill bit.

The foregoing description and figures are not drawn to scale, but rather are illustrated to describe various embodiments of the present disclosure in simplistic form. Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

In several exemplary embodiments, while different steps, processes, and procedures are described as appearing as distinct acts, one or more of the steps, one or more of the processes, and/or one or more of the procedures could also be performed in different orders, simultaneously and/or sequentially. In several exemplary embodiments, the steps, processes and/or procedures could be merged into one or more steps, processes and/or procedures.

It is understood that variations may be made in the foregoing without departing from the scope of the disclosure. Furthermore, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. A method, comprising:

extending a wellbore using a drill bit;

enlarging a diameter of the wellbore using a first tool to reduce a dogleg capability of a bottom hole assembly comprising a second tool;

laterally offsetting the second tool in the enlarged diameter wellbore;

wherein extending the wellbore using the drill bit, enlarging the diameter of the wellbore, and laterally offsetting the second tool in the enlarged diameter wellbore occur simultaneously to drill a first curved section that has a first dogleg severity; and creating a second curved section of the wellbore having a second dogleg severity that is greater than the first dogleg severity, wherein creating the second curved section comprises extending the wellbore using the drill bit such that the wellbore has an original diameter while simultaneously laterally offsetting the second tool in the original diameter wellbore;

wherein the first tool, the second tool, and the drill bit are coupled together such that the first tool is positioned between the drill bit and the second tool; and wherein a bend angle is defined between a central axis of the second tool and a central axis of the drill bit.

2. The method of claim 1, wherein laterally offsetting the second tool in the enlarged diameter occurs while the second tool and the drill bit are rotated to drill a straight section of the wellbore.

3. The method of claim 1, wherein the method further comprises extending the wellbore using the drill bit such that the wellbore has an original diameter while simultaneously laterally offsetting the second tool in the original diameter wellbore to drill a first curved section having a first radius of curvature;

wherein extending the wellbore using the drill bit, enlarging the diameter of the wellbore, and laterally offsetting the second tool in the enlarged diameter wellbore occur simultaneously to drill a second curved section having a second radius of curvature; and wherein the second radius of curvature is greater than the first radius of curvature.

4. The method of claim 1, wherein the method further comprises extending the wellbore using the drill bit such that the wellbore has an original diameter while simultaneously laterally offsetting the second tool in the original diameter wellbore such that the second tool is laterally offset from a center of the wellbore by a first distance; and wherein, when the second tool is laterally offset in the enlarged diameter wellbore the second tool is laterally offset from the center of the wellbore by a second distance that is greater than the first distance to reduce a lateral force exerted on the drill bit.

5. The method of claim 1, wherein the first tool is a reamer and enlarging the diameter of the wellbore comprises activating the reamer.

6. The method of claim 5, further comprising deactivating the reamer.

7. The method of claim 1, wherein the second tool is a mud motor or a rotary steerable system.

8. The method of claim 1, wherein the first tool comprises a reamer and wherein enlarging the diameter of the wellbore comprises irreversibly activating the reamer.

9. The method of claim 1, wherein the second tool is a rotary steerable system.

10. A method, the method comprising;

using a drill bit and a mud motor having a bend angle to extend a wellbore, while simultaneously enlarging a diameter of the wellbore using a reamer positioned between at least a portion of the drill bit and at least a portion of the mud motor;

laterally offsetting the mud motor in the enlarged diameter wellbore; and using the drill bit and the mud motor to extend the wellbore, such that the wellbore has an original diameter, while simultaneously laterally offsetting the mud motor in the original diameter wellbore;

wherein enlarging the diameter of the wellbore reduces a dogleg capability of a bottom hole assembly comprising the mud motor.

11. The method of claim 10, wherein extending the wellbore using the drill bit and the mud motor, enlarging the diameter of the wellbore, and laterally offsetting the mud motor in the enlarged diameter wellbore, occur simultaneously during rotational drilling of a straight section of the wellbore; and wherein extending the wellbore, using the drill bit and the mud motor, such that the wellbore has the original diameter while simultaneously laterally offsetting the mud motor in the original diameter wellbore occurs during steering of the drill bit.

12. The method of claim 10, wherein extending the wellbore, using the drill bit and the mud motor, such that the wellbore has an original diameter while simultaneously laterally offsetting the mud motor in the original diameter wellbore creates a portion of the wellbore having a first radius of curvature; and wherein extending the wellbore using the drill bit and the mud motor, enlarging the diameter of the wellbore, and laterally offsetting the mud motor in the enlarged diameter wellbore creates another portion of the wellbore having a second radius of curvature that is greater than the first radius of curvature.

13. The method of claim 10, wherein enlarging the diameter of the wellbore comprises irreversibly activating the reamer.

14. A point-the-bit bottom hole assembly, comprising:

a drill bit;

a mud motor operably coupled to the drill bit; and a reamer positioned between at least a portion of the mud motor and at least a portion of the drill bit;

wherein the reamer is movable between a first configuration and a second configuration;

wherein the reamer comprises shear pins and wherein the reamer is configured to irreversibly move from the first configuration to the second configuration;

wherein, when in the first configuration, a cutting structure of the reamer that is capable of extending radially in a direction perpendicular to a longitudinal axis of the reamer is retracted;

wherein, when in the second configuration, the cutting structure is radially extended to form an outermost diameter of the reamer, the outermost diameter of the reamer being greater than an outer diameter of the drill bit such that the cutting structure enlarges a diameter of a wellbore having an original diameter formed by the drill bit;

wherein the bottom hole assembly has a reduced dogleg capability in the enlarged diameter as compared with the original diameter; and wherein the drill bit is configured to operate when the reamer is in the first configuration and when the reamer is in the second configuration.

15. The point-the-bit bottom hole assembly of claim 14, wherein the mud motor defines a bend angle.

16. The point-the-bit bottom hole assembly of claim 15, wherein the bend angle defined by the mud motor is fixed in operation downhole.

17. The point-the-bit bottom hole assembly of claim 14, further comprising a control unit operably coupled to the reamer, the control unit operable to actuate the reamer from the first configuration to the second configuration.

18. The point-the-bit bottom hole assembly of claim 17, wherein the control unit includes one or more logging-while-drilling (LWD) systems or one or more measurement-while-drilling (MWD) systems.

19. The point-the-bit bottom hole assembly of claim 14, wherein the reamer forms a portion of the drill bit.

20. The point-the-bit bottom hole assembly of claim 14, wherein the cutting structure is one of a plurality of reamer cutting structures circumferentially spaced about the reamer.

* * * * *